US006540487B2

(12) United States Patent
Polizos et al.

(10) Patent No.: US 6,540,487 B2
(45) Date of Patent: Apr. 1, 2003

(54) PRESSURE EXCHANGER WITH AN ANTI-CAVITATION PRESSURE RELIEF SYSTEM IN THE END COVERS

(75) Inventors: Thanos Polizos, Virginia Beach, VA (US); Thomas Babcock, Virginia Beach, VA (US); Leif J. Hauge, Virginia Beach, VA (US); Ragnar A. Hermanstad, Hitra (NO)

(73) Assignee: Energy Recovery, Inc., San Leandro, CA (US)

( * ) Notice: Subject to any disclaimer, the term of this patent is extended or adjusted under 35 U.S.C. 154(b) by 0 days.

(21) Appl. No.: 09/833,252

(22) Filed: Apr. 10, 2001

(65) Prior Publication Data

US 2002/0025264 A1 Feb. 28, 2002

(Under 37 CFR 1.47)

(51) Int. Cl.[7] ..... F04F 11/00; B01D 61/00

(52) U.S. Cl. ..... 417/65; 417/92; 417/103; 417/375; 417/405; 210/652

(58) Field of Search ..... 417/65, 64, 92, 417/103, 375, 405; 210/642, 644, 652

(56) References Cited

U.S. PATENT DOCUMENTS 2,968,435 A * 1/1961 Jendrassik ..... 417/64
3,109,580 A * 11/1963 Kentfield ..... 417/64
3,209,986 A * 10/1965 Kentfield ..... 417/64
3,234,736 A * 2/1966 Spalding ..... 417/64
3,536,419 A * 10/1970 Williamson ..... 417/64
4,887,942 A * 12/1989 Hauge ..... 417/64
5,338,158 A * 8/1994 Hauge ..... 417/64
5,988,993 A * 11/1999 Hauge ..... 417/365

* cited by examiner

*Primary Examiner*—Charles G. Freay
*Assistant Examiner*—Michael K. Gray
(74) *Attorney, Agent, or Firm*—Gray, Cary, Ware & Freidenrich

(57) ABSTRACT

A pressure exchanger for simultaneously reducing the pressure of a high pressure liquid and pressurizing a low pressure liquid. The pressure exchanger has a housing having a body portion; with end elements at opposite ends of the body portion. A rotor is in the body portion of the housing and in substantially sealing contact with the end plates. The rotor has at least one channel extending substantially longitudinally from one end of the rotor to the opposite end of the rotor with an opening at each end. The channels of the rotor are positioned in the rotor for alternate hydraulic communication with 1) high pressure liquid and 2) low pressure liquid, in order to transfer pressure between the high pressure liquid and the low pressure liquid. Because of the high pressures and the high angular velocities, this is a highly cavitation prone structure, In order to prevent cavitation, there are one or more grooves in one or both of the end plates. These grooves bleed pressure out of the channels, for example to a lower pressure channel or to a sealing volume between the end piece and the rotor.

18 Claims, 9 Drawing Sheets

PRESSURE EXCHANGER WITH AN ANTI-CAVITATION PRESSURE RELIEF SYSTEM IN THE END COVERS

FIELD OF THE INVENTION

The invention relates to pressure exchangers where a liquid under a high pressure hydraulically communicates, through a working liquid, with a lower pressure, second liquid, and transfers pressure between the liquids. More particularly, the invention relates to cavitation control and anti-cavitation elements, especially in rotary pressure exchangers.

BACKGROUND OF INVENTION

Many industrial processes, especially chemical processes, operate at elevated pressures. These processes require a high pressure feed, and produce a high pressure product (including high pressure effluents). One way of obtaining a high pressure feed to an industrial process is by feeding relatively low pressure feed through a pressure exchanger to exchange pressure between the high pressure effluent and the low pressure feed. One type of pressure exchanger is a rotary pressure exchanger. Rotary pressure exchangers have a rapidly rotating rotor with channels through the rotor to allow hydraulic communication between the high pressure liquids and thereafter the low pressure liquids, through the working liquid.

U.S. Pat. No. 4,887,942, U.S. Pat. No. 5,338,158, and U.S. Pat. No. 5,988,993, all three of which are incorporated herein by reference, discuss rotary pressure exchangers of the general type described herein, for transferring pressure energy from one fluid to another. This type of pressure exchanger is a direct application of Pascal's Law, which may be stated as "Pressure applied to an enclosed fluid is transmitted undiminished to every portion of the fluid and the walls of the containing vessel." Pascal's Law means that if a high pressure fluid is brought into hydraulic contact with a low pressure fluid, the pressure of the high pressure fluid is reduced, the pressure of the low pressure fluid is increased, and the pressure exchange is accomplished with minimum mixing. The pressure exchanger applies Pascal's Law by alternately and sequentially (1) bringing a channel, which contains a low pressure working liquid, into hydraulic contact with a first chamber containing high pressure liquid, thereby depressurizing the liquid in the chamber, and pressurizing the working liquid in the channel; and (2) bringing the channel, which now contains high pressure working liquid, into hydraulic contact with a second chamber containing low pressure liquid, thereby pressurizing the low pressure liquid in the second chamber and depressurizing the high pressure working liquid in the channel.

The net result of the pressure exchange process, in accordance with Pascal's Law, is to cause the pressures of the two fluids to approach one another. The result is that, in a chemical process operating at high pressures, e.g., 950–1000 psi, where the feed is generally available at low pressures, e.g., atmospheric pressure to about 50 psi, and the product is available from the process at 950–1000 psi, the low pressure feed and the high pressure product are both fed to the pressure exchanger to pressurize fresh feed and depressurize product. The industrially applicable effect of the pressure exchanger on an industrial process is the reduction of high pressure pumping capacity needed to raise the feed to high pressures. This can result in an energy reduction of up to 65% for the process and a corresponding reduction in pump size.

In a rotary pressure exchanger, a rotor carries the working liquid in a channel, and the rotation of the rotor provides alternating hydraulic communication of the working liquid in the channel with the high pressure liquid in the chambers exclusively, and, a short interval later, with the low pressure liquid in the chambers exclusively. The channel has openings at each end, one opening for hydraulic communication with the first chamber, and one opening for hydraulic communication with the second chamber. Because of the countercurrent flow of the two feed streams, the initially high pressure feed and the initially low pressure feed streams, in the manifolds, the channel is in hydraulic communication with high pressure liquid and thereafter with low pressure liquid.

Rotary pressure exchangers have a rapidly rotating rotor with a plurality of substantially longitudinal channels extending through the rotor. These channels allow many very brief intervals of hydraulic communication through the working liquid in the channel between the two liquids. The two liquids are otherwise hydraulically isolated from each other. There is minimal mixing or leakage in the channels. This is because the channels have a zone of relatively dead liquid, the working liquid, as an interface in the channels between the two liquids. This permits the high pressure liquid to transfer its pressure to the lower pressure liquid, thereby exchanging pressure between the liquids.

The rotor is present in a cylindrical housing, with the end elements of the exchanger having end plates with openings for mating with the channels in the rotor so as to be alternately in hydraulic communication with high pressure working liquid in one channel and subsequently low pressure working liquid in another channel, and being sealed off from the channels between the intervals of hydraulic communication, as the channels rotate.

The rotor in the pressure exchanger is supported by a hydrostatic bearing and driven by either the flow of fluids through the rotor channels and exchanger manifolds or a pump motor. In order to accomplish this, extremely low friction is required. For this reason the pressure exchanger does not use rotating seals. Instead, fluid seals and fluid bearings are used. Extremely close tolerance fits are used to minimize leakage. In use, internal leakage constantly occurs from higher-pressure areas to lower pressure areas, but, absent cavitation, the amount of internal leakage is generally constant over the operating range of the pressure exchanger, and this internal leakage has minimal to no effect on the downstream industrial process, other than to marginally lower the overall efficiency of the downstream process.

In most applications of pressure exchangers, the pressure exchangers are used with low viscosity, incompressible fluids, e.g. water. Any abnormal internal leakage between areas with high and low pressure, especially leakage associated with cavitation, cavitation damage, and cavitation erosion, substantially reduces hydraulic efficiency in the exchanger. If this leakage becomes uncontrolled, for example, as the result of vibrations and acoustic waves from cavitation, it can lead to still more cavitation at the outlet, especially if the sealing surfaces are not functioning satisfactorily, with a severely reduced working life as a consequence. Furthermore, any dramatic change in pressure, such as the fluid sees as it moves from high to low pressure areas in the end plates, can create cavitation.

Because of the high pressure drops involved, the high rotational speeds involved, and the closeness of the elements, typically on the order of microns to tens of microns, the rotary pressure exchanger is highly susceptible to cavitation and to damage from cavitation, such as, cavitation erosion, and power robbing vibrations. The high pressure drops, close tolerances, and high rotational velocities all contribute to the need for effective cavitation control.

"Cavitation" as used herein is the formation and collapse of vapor cavities in a flowing liquid. Cavitation occurs whenever the local pressure is quickly reduced to or below that of the liquid's vapor pressure. The formation and instantaneous collapse of innumerable tiny cavities or bubbles within a liquid characterize cavitation, especially when the liquid is subjected to rapid and intense changes in pressure. One adverse effect of cavitation is "cavitation erosion." In cavitation erosion, the cavities pit and erode the surface where they form. Another adverse effect of cavitation is the noise and vibration associated with bubbles forming and bursting, especially when such noise and vibration occurs in narrow fluid seals.

The cavitation potential of end clearance leakage outflow of the low pressure side is a limiting design factor. It is therefore highly desirable to reduce the cavitation susceptibility of the outlets of the rotor channels and end plate apertures. And, it is to these ends that the present invention is directed.

SUMMARY OF THE INVENTION

According to the invention, cavitation is controlled and substantially eliminated by the controlled bleeding and shunting of high pressure liquid in a channel to either an appropriate liquid seal or a lower pressure channel. The structure and apparatus of this invention substantially reduces cavitation, and associated problems, such as cavitation erosion, pitting, vibration, and noise in devices such as pressure exchangers which transfer pressure from a high pressure liquid to a low pressure liquid, and therefore, it reduces the need for increased pumping power. The pressure exchanger transfers pressure between a high pressure liquid feed and a low pressure liquid feed in a pressure exchanger system that includes a housing with two end covers. Each end plate has an inlet and an outlet aperture. The apertures of one end plate are aligned with the apertures of the opposite end plate to allow pressure exchange between the liquids in the manifolds. A cylindrical rotor is inside the housing and is arranged for rotation about the housing's longitudinal axis. The rotor has a number of through-going channels with openings at each end arranged symmetrically about the longitudinal axis. While the channels are arranged symmetrically about the longitudinal axis of the rotor, they may be offset from parallel longitudinal alignment with the longitudinal axis of the rotor to capture angular momentum and provide angular velocity to the rotor. The rotor's channels are arranged for periodic hydraulic communication with a pair of apertures, one in each end plate, in such a manner that during rotation they alternately expose fluids at high pressure to each other and thereafter fluids at low pressure to each other through the working fluid in the channel. The end plates' or end covers' inlet and outlet apertures are designed with perpendicular flow cross sections in the form of segments of a circle. An anti-cavitation structure, in the form of a recess, groove, or recessed channel is present in either one or both of the end plates.

In the rotary pressure exchanger of the invention, the structure for controlling and eliminating cavitation is part of the end plates and provides a pressure change in the channel while the channel is blocked by the end plates. This partially depressurizes the channel. The structure may be in the form of one or more grooves, where the grooves are positioned to provide hydraulic communication between the openings of the channels and the liquid seal between the rotor and the end piece. There may be one or more grooves in the end plates joining openings of the channels with the liquid seal between the rotor and the end piece to relieve pressure and prevent cavitation. The grooves are recessed into the end plate.

According to the invention one or more grooves recessed into the end plates hydraulically connect to the channels and allow for a bleed of pressure from the channels. For example, in one aspect the end plate has one or more anti-cavitation recessed grooves periodically connecting to channel outlets in the rotor and bleeding fluid and pressure to the liquid seal volume between the end cap and the rotor. In another aspect of the invention, the end plate has one or more anti-cavitation recessed grooves hydraulically joining the inlets/outlets of appropriate channels in the rotor to bleed or shunt high pressure and high pressure fluid both to a low pressure rotary channel and to the liquid seal volume between the end piece and the rotor.

THE FIGURES

The FIGURES illustrate certain aspects of the invention.

FIGS. 3A 3B, 3C and 3D, are a sequence of diagrammatic views looking downward through the end plate at the rotor, toward the rotor and rotor channel inlet/outlets showing the operation, as the rotor rotates clockwise carrying the channel inlet/outlets clockwise from one aperture to subsequent aperture in the end plate.

Figure 4:
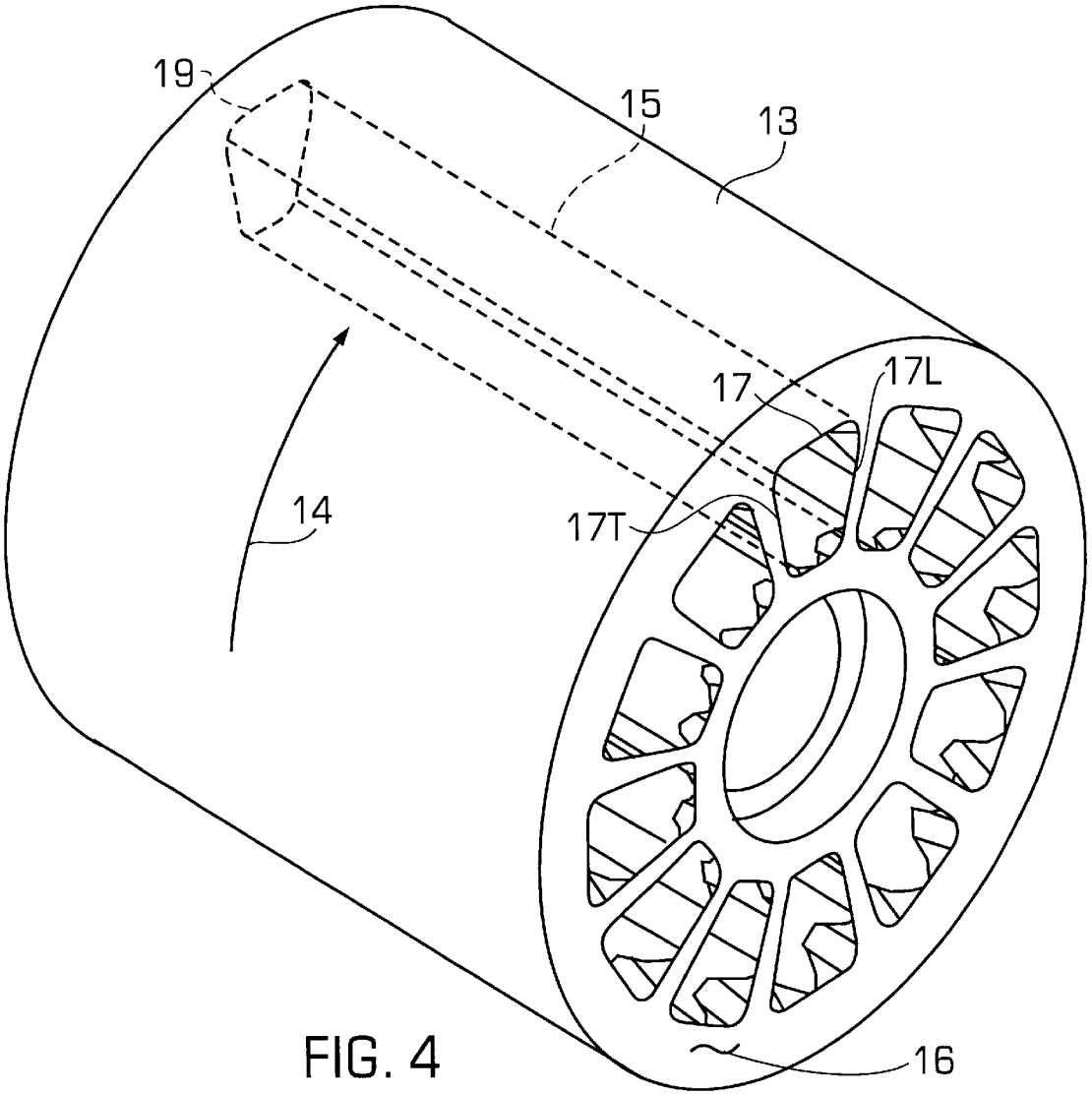

FIG. 4 is an isometric view of the rotor, showing the channels, including the leading and trailing edges of the channels.

Figure 5A:
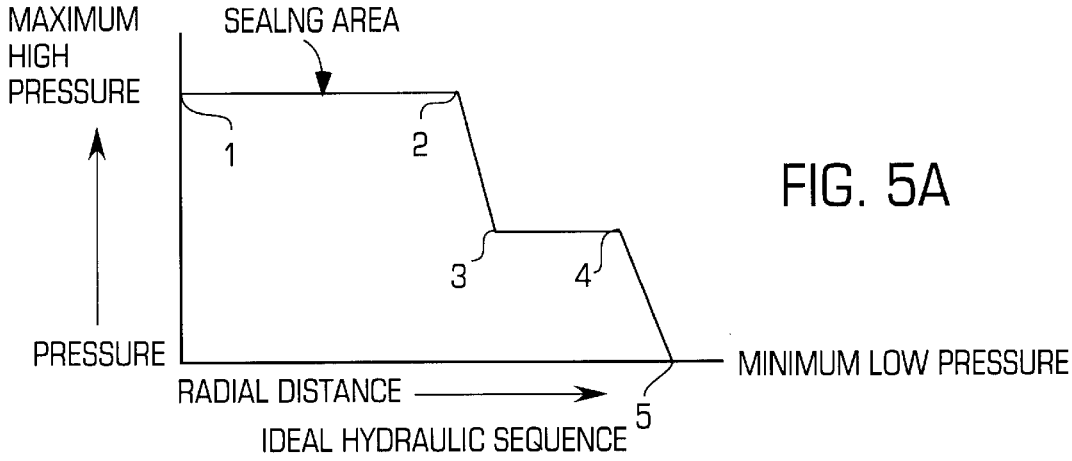
Figure 5B:
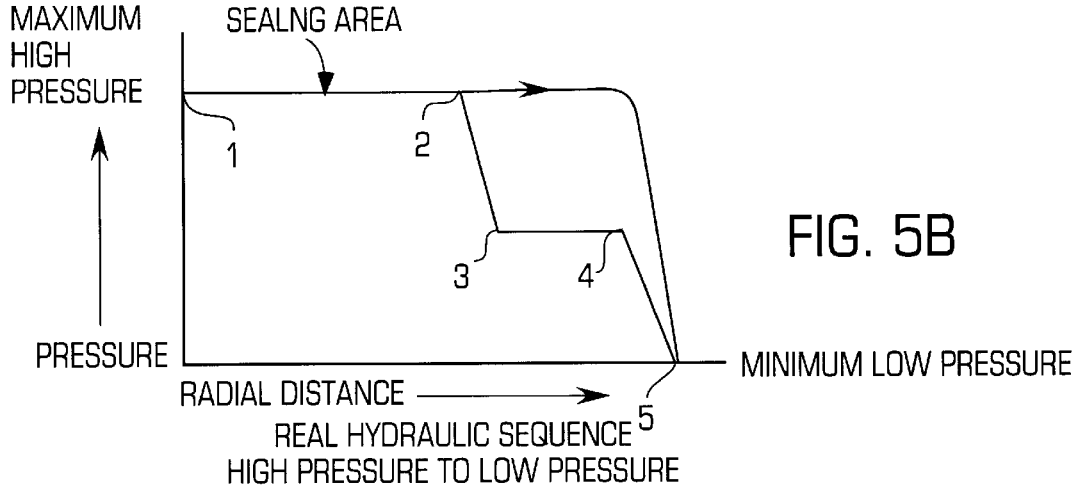
Figure 5C:
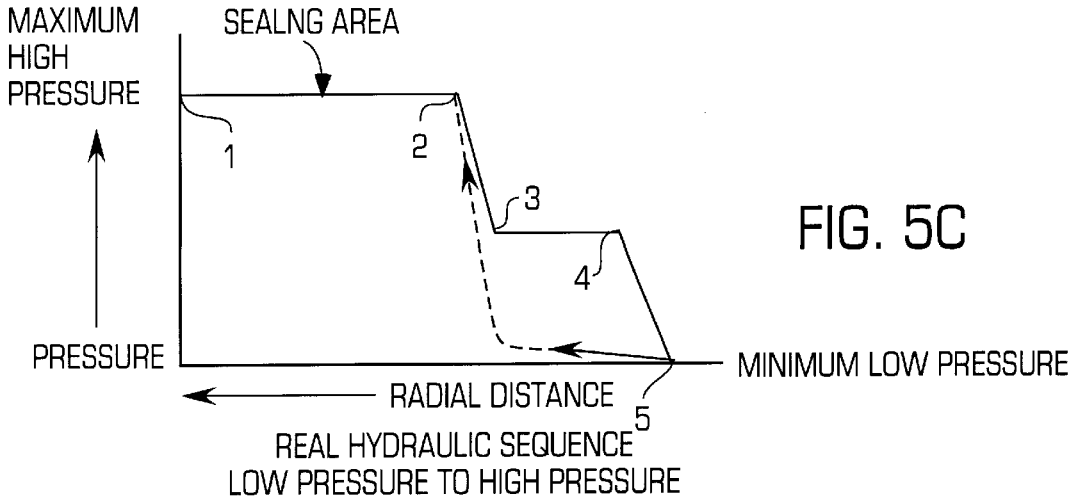

FIGS. 5A 5B, and 5C are a set of graphs comparing pressure versus angular distance for an ideal hydraulic sequence, a real hydraulic sequence going from high pressure to low pressure, and a real hydraulic sequence going from low pressure to high pressure.

Figure 6:
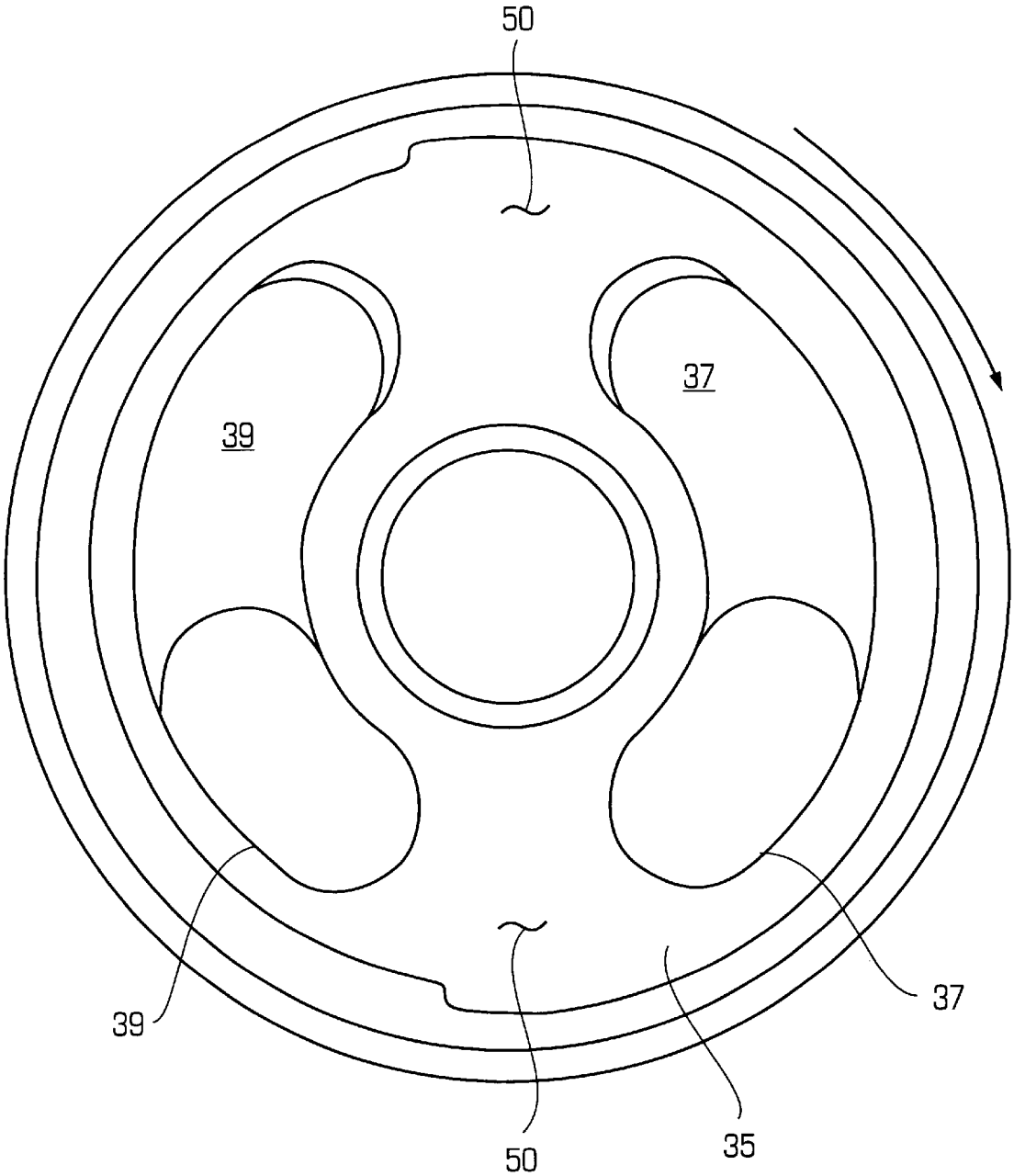

FIG. 6 is a view of an endplate, showing the apertures in the end plate, and the sealing surface of the end plate.

Figure 7:
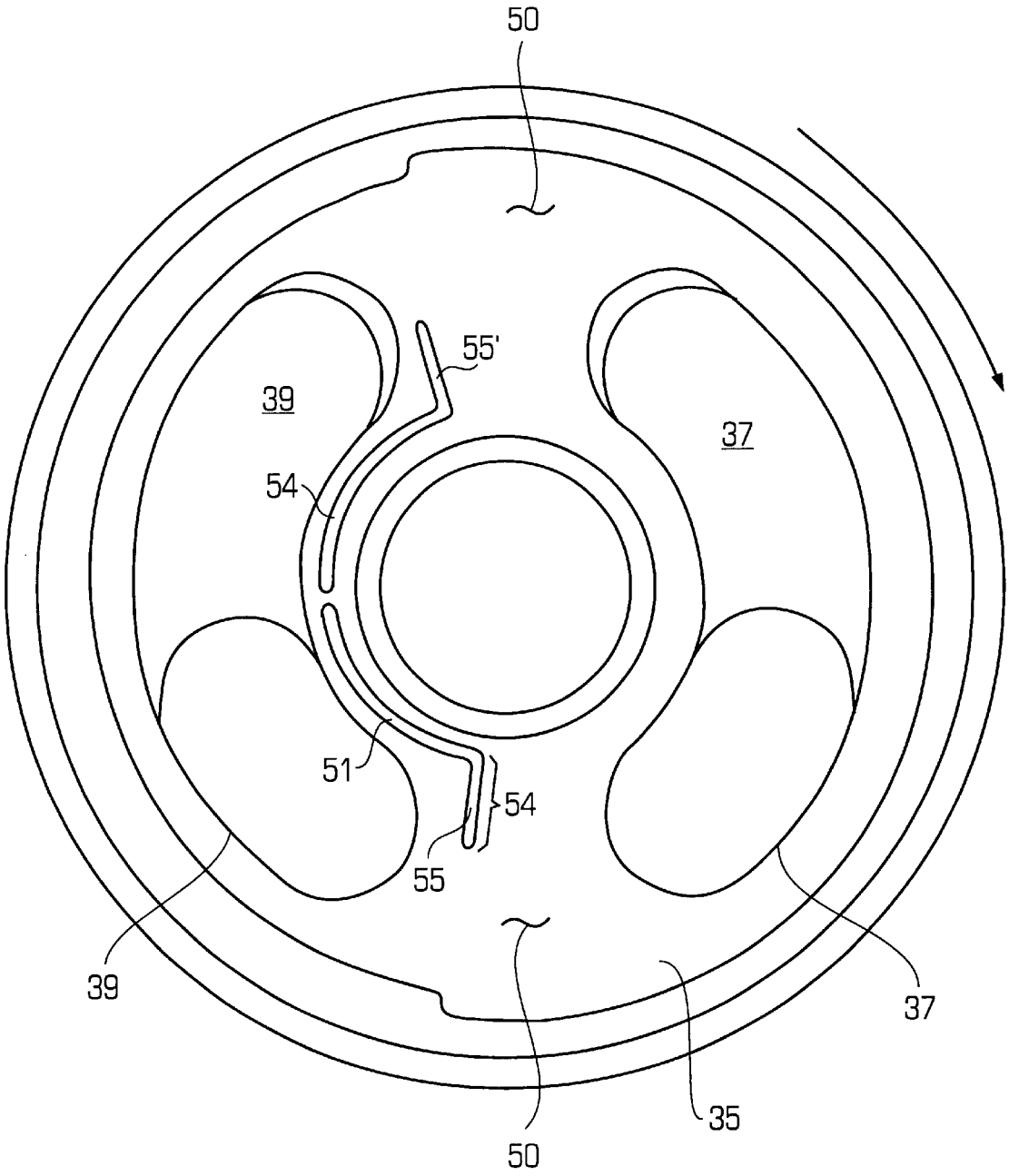

FIG. 7 is a view of an end plate showing the apertures, the sealing surface, and one embodiment of the anti-cavitation groove of the invention where the anti-cavitation groove bleeds pressure into the volume between the sealing surface of the end plate and the sealing surface of the rotor.

Figure 8:
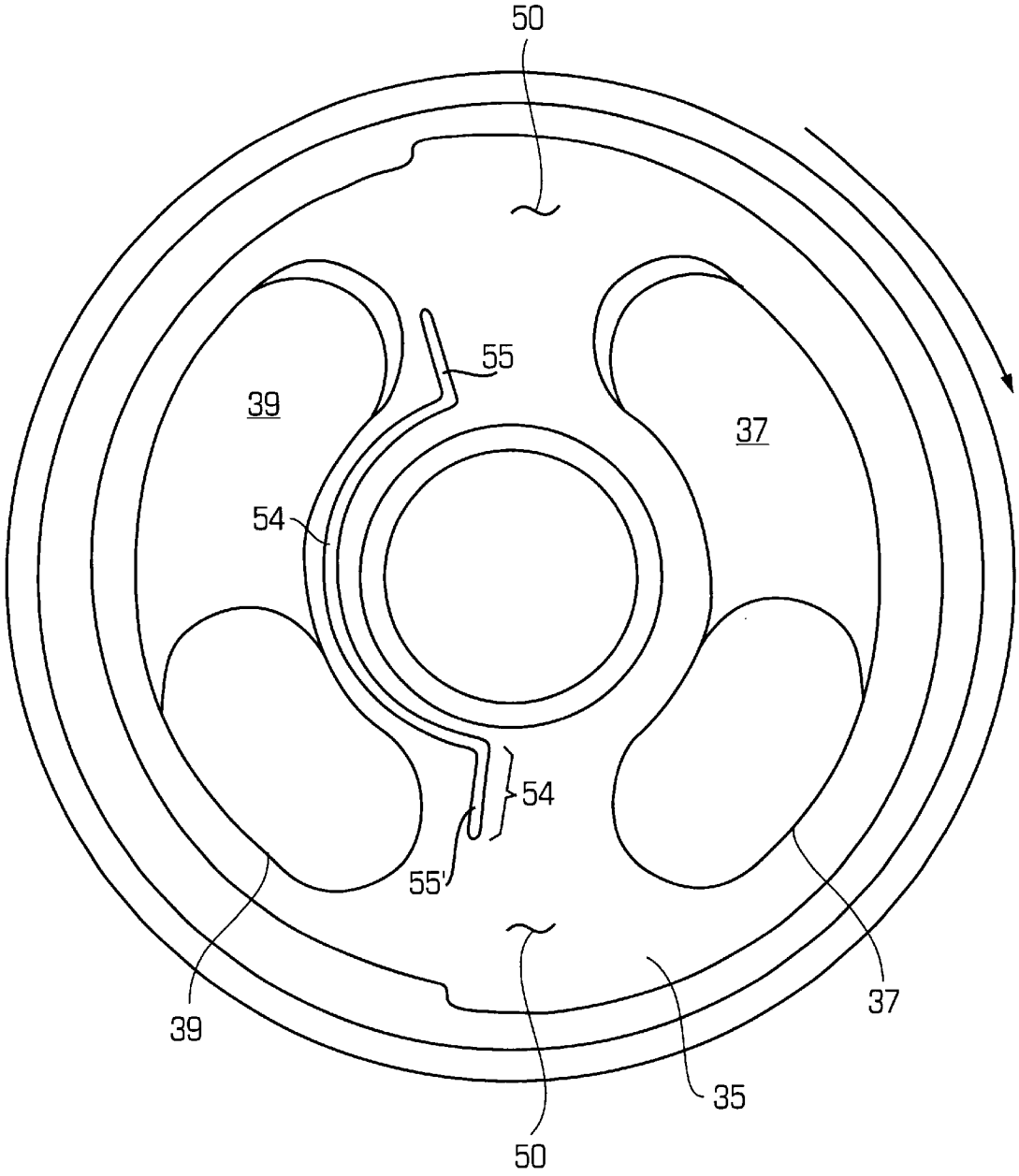

FIG. 8 is a view of an end plate, showing the apertures, the sealing surface, and an alternative embodiment of the invention where the anti-cavitation groove bleeds pressure from at channel at higher pressure to a channel at lower pressure.

Figure 9:
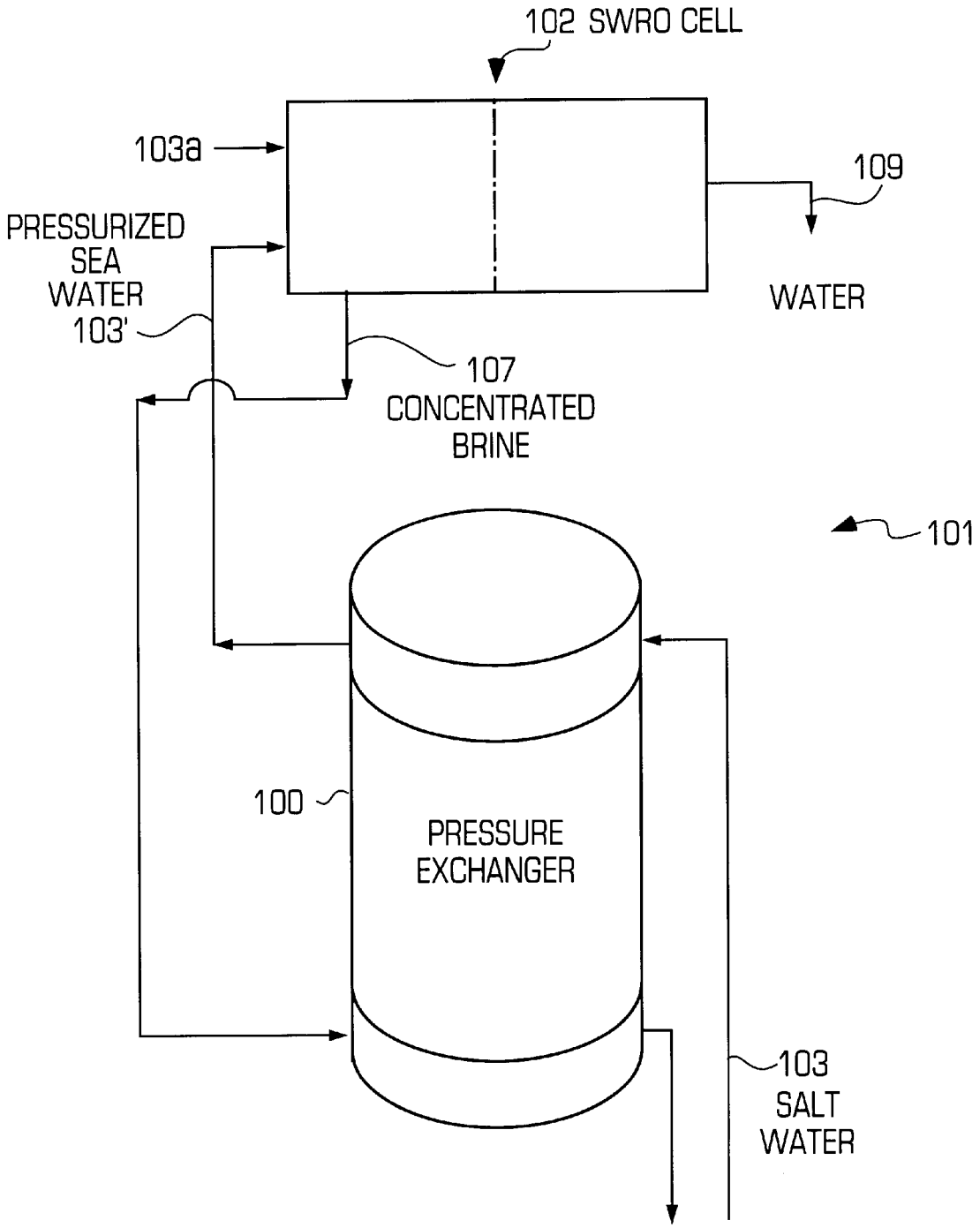

FIG. 9 is a diagrammatic view of an industrial seawater reverse osmosis process in which a seawater reverse osmosis cell is used in conjunction with a pressure exchanger of the invention.

DETAILED DESCRIPTION

The rotary pressure exchanger of the type with which the invention may be employed is illustrated generally in FIG.

1 and FIGS. 2A through 2D, the apertured end plate of the exchanger is illustrated FIGS. 3A through 3D, and the rotor with substantially longitudinal channels is illustrated in FIG. 4. The pressure exchanger, 10, may include a generally cylindrical body portion, 11, comprising a housing, 12, and rotor, 13, and two end structures, designated generally as 31 and 51, comprising manifolds 41, 53 with inlet and outlet ports, 43 and 45, 55 and 57, respectively for the fluids. The end structures, 31, and 51, include generally flat end plates, 35, 61 disposed within the manifolds 41, 53 and adapted for liquid sealing contact with the rotor, 13. The rotor, 13, may be cylindrical and disposed in the housing, 12, and is arranged for rotation about the longitudinal axis of the rotor, indicated by "¢." The rotor may have a plurality of channels, 15, 15', extending substantially longitudinally through the rotor, with openings, 17, 17' and 19, 19' at each end arranged symmetrically about the longitudinal axis, "¢." The rotor's openings, 17, 17', and 19, 19', are arranged for hydraulic communication with the end plates 35, 61, inlet and outlet apertures, 37,39, and 63, 66, in such a manner that during rotation they alternately hydraulically expose fluid at high pressure and fluid at low pressure to the respective manifolds. The inlet and outlet ports, 43, 45, 55, 57, of the end element manifolds, 41, 53, form one pair of ports for high pressure liquid in one end element, 31 or 51, and one pair of ports for low pressure liquid in the opposite end element, 51 or 31. The end plates, 35, 61, inlet and outlet apertures, 37,39, and 63, 65, are designed with perpendicular flow cross sections in the form of arcs or segments of a circle.

Figure 1:
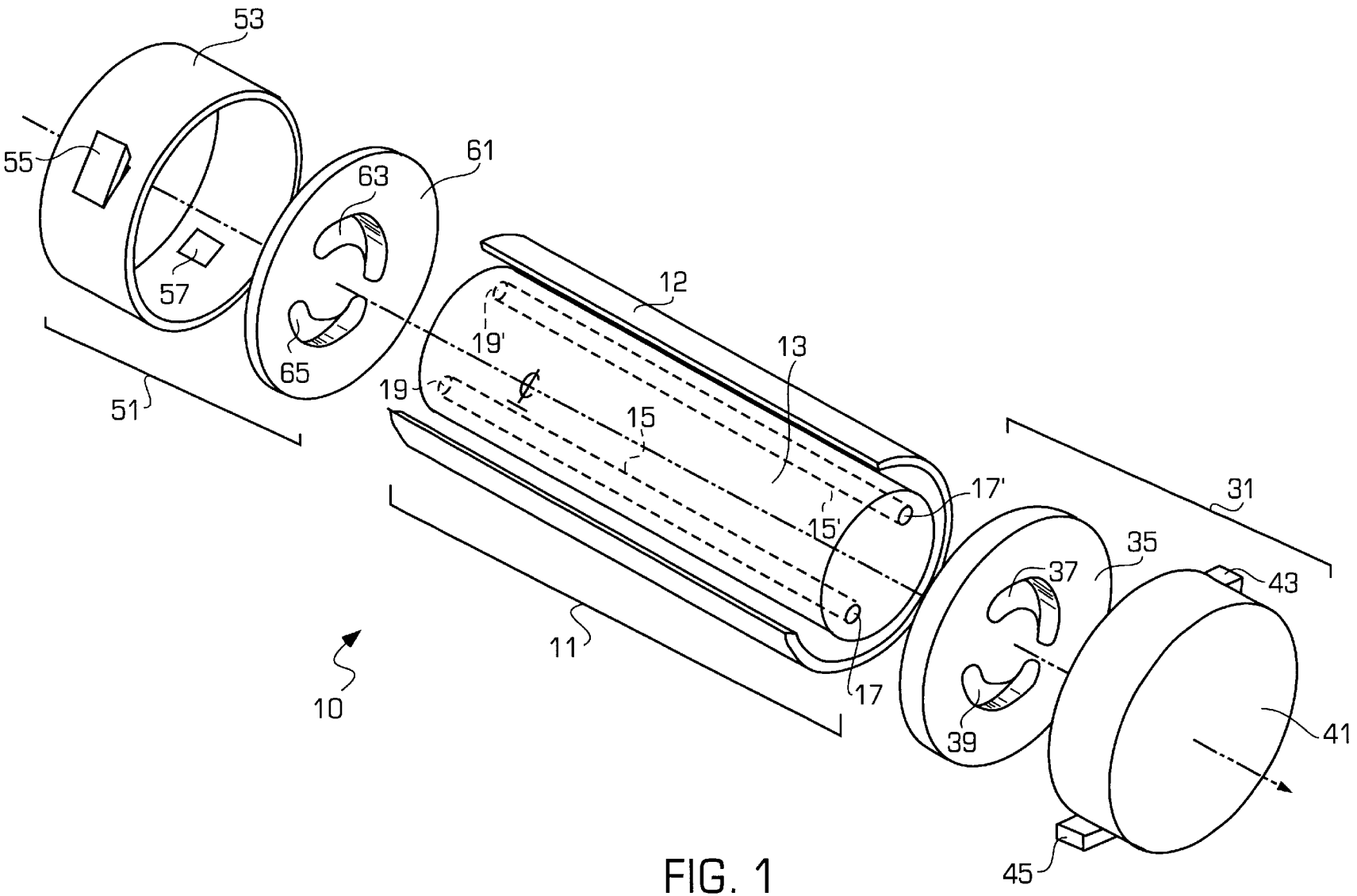
FIG. 1 is an exploded view of a rotary pressure exchanger showing a rotor, a cylindrical body surrounding the rotor, with two channels (for illustration purposes) extending through the rotor, a pair of end plates, and end elements with inlets and outlets for the liquids.
Figure 2C:
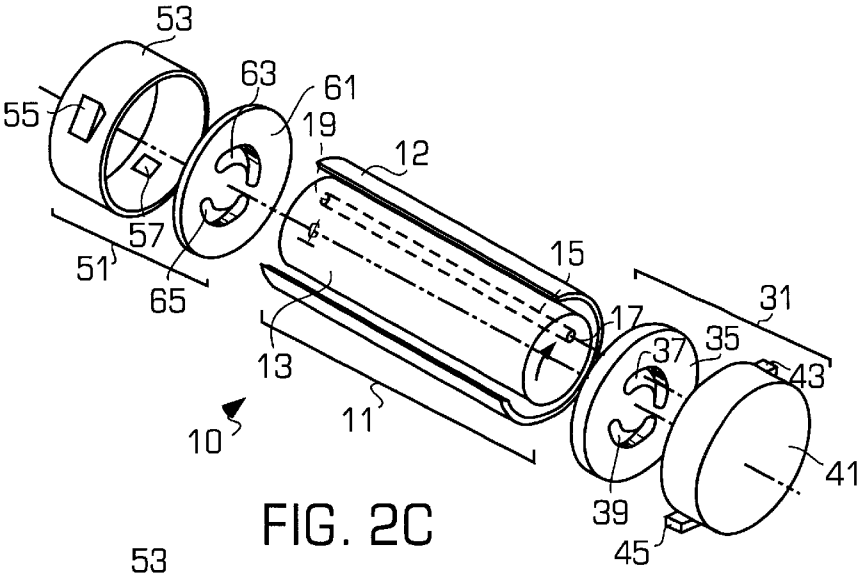
FIGS. 2A, 2B, 2C and 2D are a sequence of diagrammatic views illustrating the operation of the pressure exchanger as a channel sequentially communicates with high and low pressure liquids in the pressure exchanger.
Figure 2D:
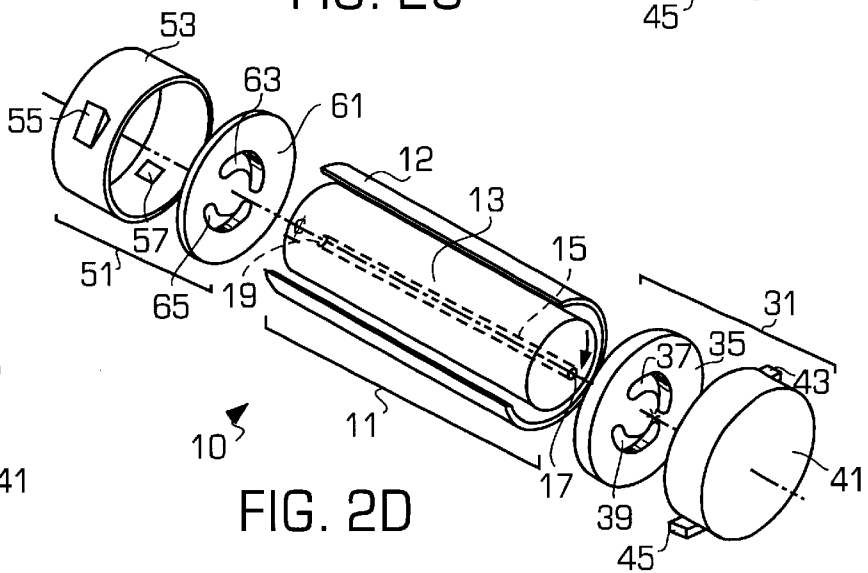
Figure 2A:
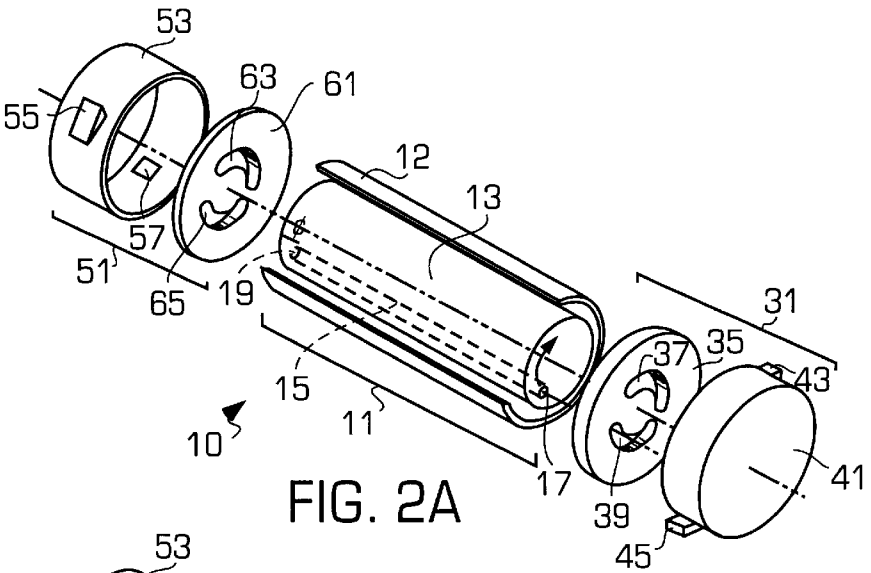
Figure 2B:
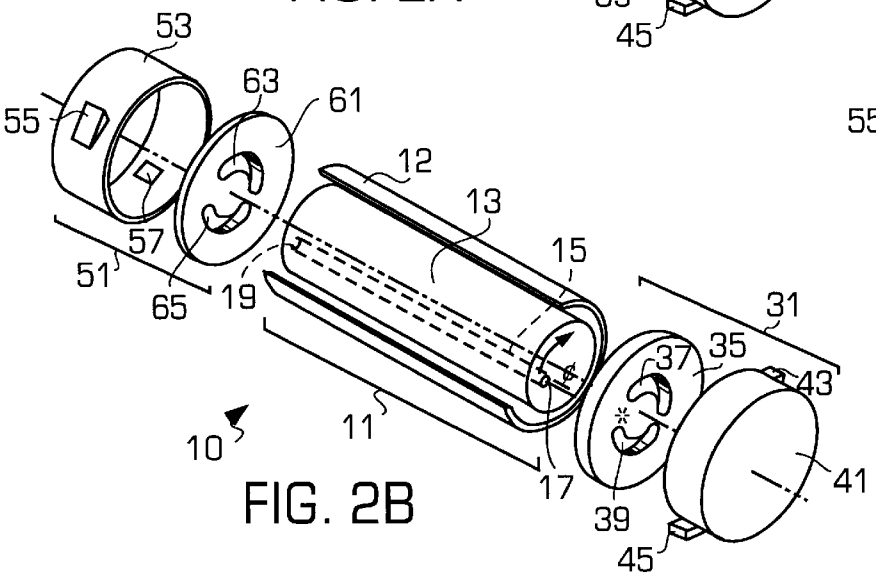
Figures 3A, 3B, 3C, 3D:
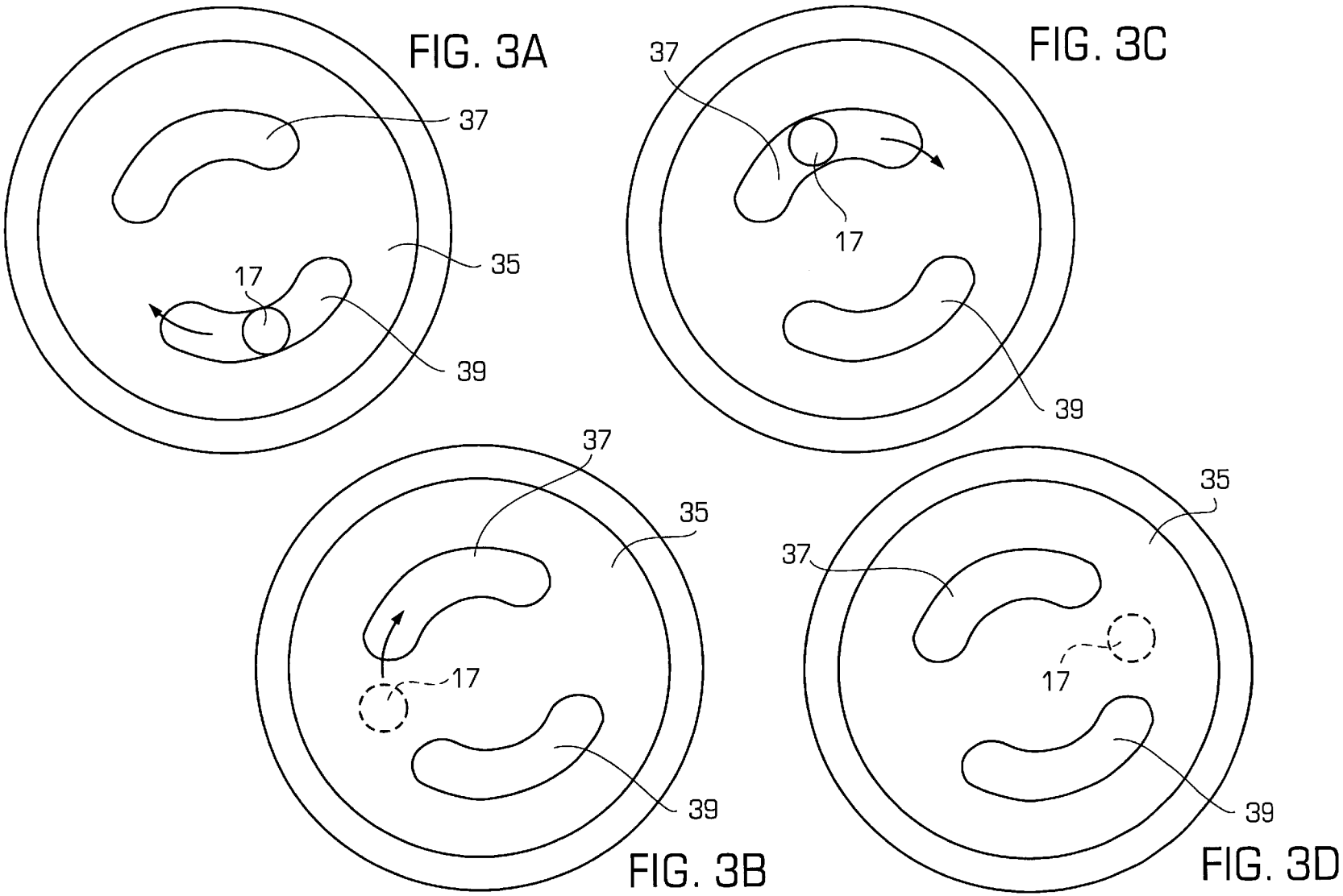

FIGS. 2A through 2D, and FIGS. 3A through 3D, illustrate the sequence of the positions of a single channel, 15, in the rotor, 13, as the channel rotates through a complete cycle and are useful to an understanding of the pressure exchanger. In FIGS. 2A and 3A the channel opening, 17, is in hydraulic communication with aperture 39, in endplate 35 and therefore with the manifold, 41, at a first rotational position of the rotor, 13, and opposite channel opening 19 is in communication with the aperture 65 in endplate 61, and thus, in hydraulic communication with manifold 53.

In FIGS. 2B and 3B, the channel, 15, has rotated (clockwise in the FIGURE) through an arc of 90 degrees, and outlet 19 is now blanked off between apertures 63 and 65 in end element 61, and outlet 17 of the channel is located between the apertures, 37, 39, in end plate 35 and, thus, blanked off from hydraulic communication with the manifold 41 of end element 31

In FIGS. 2C and 3C, the channel, 15, has rotated through 180 degrees of arc from the positions shown in FIGS. 2A and 3A. Opening 19 is in hydraulic communication with aperture 65 in end plate 61, and in hydraulic communication with manifold 53, and the opening, 17 of the channel, 15, is in hydraulic communication with aperture 37 of end plate 35 and with manifold 41 of end element 31. The fluid in channel, 15, which was at the pressure of manifold 53 of end element 51, transfers this pressure to end element 31 through outlet 17 and aperture 37, and comes to the pressure of manifold 41 of end element 31.

In FIGS. 2D and 3D the channel has rotated through 270 degrees of arc from the positions shown in FIGS. 2A and 3A, and the openings 17 and 19 of channel 15 are between apertures 37 and 39 of end plate 35, while and between apertures 63 and 65 of end plate 61.

To be noted is that FIGS. 2 and 3 are simplifications of the actual pressure exchanger, showing only one channel, 15, and the channel, 15, is shown as being round. These are simplifications for purposes of illustration.

FIG. 4 is an isometric view of one embodiment of a channeled rotor, 13, which may be employed in a pressure exchanger in accordance with the invention. The rotor, 13, is shown with twelve channels, 15, although there may be more channels, 15, or fewer channels, 15. The channels, 15, have openings in the rotor end surfaces, 16, which are shown as having a quadrilateral profile, although they may be round, oval, hexagonal, or have other shapes. The rotor, 13, end surfaces, 16, bear against the corresponding end plates, 35 and 61, to provide the liquid seal referred to above. This liquid seal is on the order of a few microns thick, the actual thickness being a function of the polish on the bearing surfaces of end plates, 35, 61, the polish on the bearing surface, 16, of the rotor, 13, the applied compression on the surfaces, the temperature, the pressure, and the viscosity of the liquid, and the rotational velocity of the rotor, 13. These factors may all be determined by routine experimentation.

The rotor rotates in the direction indicated by the arrow, 14. To be noted is that each outlet, 17, is shown with a leading edge, 17L, and a trailing edge, 17T. The roles of the leading edge, 17L, and of the trailing edge, 17T, will be explained with respect to cavitation, in the discussion of FIG. 5, below.

The relationship of a rotor channel, 15, and its openings, 17 and 19, with the corresponding endplates, 35, 61, and their apertures, 37, 39, and 63, 65, and the sealing surfaces, 16, and 50, is complex. The sealing area is the abutment or end clearance between the ends of the rotor, 13, and each of the end plates, 35, 61. As pressure moves from a high pressure aperture to a low pressure aperture it crosses the sealing area. At the end of the sealing area, as the channel opening moves into hydraulic communication with a low pressure aperture, a sudden change in pressure occurs. Any rapid and large change in pressure can create cavitation. Cavitation occurs when the local pressure drops below the vapor pressure of the working fluid, such that vaporization occurs or the formation of vapor cavities occurs. These bubbles and cavities implode and may cause pitting on any nearby solid boundary surfaces. The invention provides a controlled depressurization groove across the sealing area, as will be explained in connection FIG. 5, and shown in FIGS. 7 and 8.

FIGS. 5A through 5C are a set of pressure-radial distance diagrams showing the hydraulic pressures for ideal and actual conditions. FIG. 5A is a chart illustrating an ideal hydraulic sequence where the depressurization occurs in delta pressure increments that are smaller then the minimum pressure increment to initiate cavitation. The rotor channel 15 undergoes a distinct hydraulic sequences as it goes from high pressure to low pressure, and vice versa.

FIG. 5A illustrates an ideal sequence where the channel, 15, pressurized at one manifold, bleeds approximately one half of its pressure into the fluid seal between the ends of the rotor and the endplates of the end pieces, and finally discharges the remaining pressure through an aperture in the opposite endplate. The "delta pressure" increments are less then the "delta pressure" necessary for initiation of cavitation.

Between radial distance points 1 and 2 the channel is in hydraulic communication via an inlet aperture in an end plate with high pressure, and is being pressurized to high pressure. During this time the liquid in the channel, 15, is in hydraulic equilibrium with pressurized liquid. At point 2, the trailing edge, 17T, of the channel wall is entering the sealing area between the rotor, 13, and an endplate 35, 61. From point 2, to point 3, as the outlet, 17, 19, of the channel moves across the sealing area of the endplate, the pressure in the channel falls to the pressure in the seal (from point 3 to point 4). At point 4, the leading edge, 17L of the channel outlet leaves the sealing area and comes into direct communication with the aperture in the low pressure end plate. Between points 4 and 5 the channel comes to hydraulic equilibrium with the liquid in the low pressure manifold. The pressure value indicated by the horizontal segment 3–4, and the presence or absence of a slope in segment 3–4 are all arbitrary. What is significant is that while the "delta P" from point 1 to point 5 is high enough to result in cavitation, the individual "delta P" values from 2 to 3 and from 4 to 5 are too small to result in cavitation. The solution to the cavitation problem in a rotary pressure exchanger is to bleed off pressure in the channel, between the time the channel liquid is pressurized and the time the channel liquid is depressurized. The amount of pressure bled off must be such to avoid cavitation, that is, the "delta P' values from point 2 to point 3, and from point 4 to pint 5 must be below the "delta P" at which cavitation occurs.

Assuming the water is ideally incompressible and excluding the effect of rotation, the basic pressure diagram for any channel, 15, moving across the sealing area would be the same whether it goes from high pressure to low pressure, or from low pressure to high pressure.

FIG. 5B, shows an actual hydraulic sequence in a conventional pressure exchanger, as the dotted line superimposed over the ideal case, which disregards the effect of rotation and water compressibility, and shows that there will be material changes to the hydraulic conditions inside the rotor channel, 15, and to the flow in the end sealing area. At higher RPMs the extra volume compressed in the rotor channel 15 can only escape through added leakage to the low pressureside. However, there is not enough added leakage to approach the 2-3-4-5 path of ideal depressurization. To the contrary, the actual, observed pressure-radial distance sequence is represented by the dotted line in FIG. 5B. The added leakage to the unmodified low pressure side will slow down the depressurization, lead to an unbalanced mass flow in and out of the rotor channel, 15, and exhibit the very sudden and deep pressure drop shown by the dotted line between points 2 and 5 in FIG. 5B. This produces cavitation.

The actual pressure drop curve, that is, dotted line 2–5 in FIG. 5B, is heavily influenced by the expansion of the water in the rotor channel 15 as pressure is reduced. The time sequence from point 3 to point 4 allows for less pressure drop as there must be sufficient residual pressure in the rotor channel 15 to allow for the extra volume to flow in the end clearance to the low pressure-side. When the leading edge, 17L, of the rotor channel leaves the sealing area, a steeper pressure drop follows as the resistance to outflow decreases. As a limiting case, this becomes the dotted line. Since clearance flow is proportional to pressure differential and inversely proportional to expansion flow due to the effect of water expanding in the channel, cavitation will occur. It also follows that the pressure may not be fully relieved and that the remaining energy will be emitted as noise.

The dotted line in FIG. 5C shows a non-ideal depressurization, and illustrates how trailing edge cavitation can be controlled by the invention as described below. Note that in FIG. 5C, radial movement is from right to left. Leading edge, 17L, cavitation, associated with pressurization, can only be avoided with added leakage through time sequence 5-4-3. The added leakage will lower the overall pressure drop curve and the final residual pressure.

When the rotor channel 15 goes from the low pressure side to the high pressure side, the leakage flow must compress the water in the channel, and during time sequence 5-4 in FIG. 5C the pressure inside the channel in the actual case, indicated by the dotted line, will therefore rise much slower initially then in the ideal case, shown by solid lines. During the time sequence 3-2 in FIG. 5C in an actual case, indicated by the dotted line, there will be very rapid compression in the channel, 15, which will result in cavitation and audible pressure waves.

FIGS. 5A through 5C illustrate the need to depressurize the fluid in the rotor channels, 15, before the leading edge, 17L of a channel, 15, passes over to the low pressure end plate aperture area, 37, 39. The invention accomplishes this by providing controlled depressurization of the liquid in the rotor channel, 15, before the leading edge, 17L of the channel passes over to the low pressure end plate aperture area. Water cannot flow faster than velocity of sound in water, and the liquid seal between the rotor, 15, and the end plate, 35 or 61, in the conventional pressure exchanger has a very limited ability to release pressure. At higher RPMs increasing sound levels are caused by the rapid change of pressure in the rotor passage at the time the leading edge, 17L of the channel, 15, enters into the low pressure end plate aperture area, 37, 39. At this time fluid in the pressurized passage will expand at speed of sound in water and emit much of the trapped energy as sound waves.

According to the invention described below and depicted in FIGS. 7 and 8 (with FIG. 6 showing a conventional end plate for comparison), the ideal case described and illustrated in FIG. 5A is approached, and the real cases, described and depicted in FIGS. 5B and 5C are avoided by bleeding high pressure into and through the liquid seal. The high pressure may be bled either only into the seal, or into and through the seal to a channel at a lower pressure.

In accordance with the invention, as shown in FIGS. 7 and 8, and by way of contrast with FIG. 6, an anti-cavitation groove, 54, provides both an extended time and a wider stream for an outlet, 17 or 19, the channel, 15, to bleed off pressure before the leading edge, 17L, of the channel reaches the low pressure-aperture area, 37, 63 of an end plates, 35, 61. During the angular movement of the channel outlet over the anti-cavitation groove, 54, there is a controlled pressure bleed, which dissipates the energy otherwise available to initiate cavitation.

According to the invention, there may be one or more substantially annular or arcuate segment anti-cavitation grooves, 54, in the end plates, 35, 61. In one embodiment are grooves, 54, that are sized and positioned in the end plate, 35, 61, so as to join the inlets or outlets, 17, 19 of substantially longitudinal channels, 15, at different pressures, to one another and to and through the hydraulic seals, 60, between the end plates, 35, 61 and the ends of the rotor, 13. Alternatively, the grooves provide hydraulic communication between the channels and the hydraulic seal, itself.

As shown in FIGS. 7 and 8, there may be one or more anti-cavitation grooves, 54, formed substantially as segments or sectors of an annulus having radially extending segments at each end. The grooves, 54, relieve pressure by bleeding off or shunting pressure differences into the liquid seal, or by short circuiting pressure differences between channels, 15.

As shown in FIG. 7, the anti-cavitation groove, 54, may bleed pressure between the channel, 15, and the liquid seal. Alternatively, as shown in FIG. 8, the groove, 54, may provide a hydraulic pressure short circuit between a high pressure channel and a low pressure channel, joining the inlets/outlets of adjacent substantially longitudinal channels, 15, 15'. The anti-cavitation grooves, 54 are recessed from the facing rotor, 13, surface into the end plate, 35, 61.

The anti-cavitation groove, 54, is typically in the form of a segment or sector of an annulus. "Annular" and "annulus" as used herein, mean a circle or segment or sector of a circle that is preferable of substantially constant radius, when measured from the centerline, "℄", of the end plate 35, 61, through a major portion of its length, when viewed from above.

FIGS. 7 AND 8 show preferred forms of the anti-cavitation groove 54. FIG. 6, shown for comparison, is an end plate, 31, 65, without an anti-cavitation groove. The anti-cavitation groove, 54, is formed in the end plates, 35, 61, of the end elements, 31, 51, so as to be in hydraulic communication with the channel, 15, inlets/outlets, 17, 19. In one embodiment, shown in FIG. 7, the groove, 54, extends from the radial location of one inlet/outlet, 17/19 during rotation into the hydraulic seal volume. In this embodiment hydraulic communication is between the channel and the liquid seal volume. In another embodiment, shown in FIG. 8, the groove, 54, extends from the radial location of one inlet/outlet, 17, 19, during rotation to the radial location of another inlet/outlet, 17, 19, during rotation. In this embodiment hydraulic communication is both between the channel and the liquid seal volume, and between the channel and another channel. The anti-cavitation groove, 54, may have radial extensions, such as the two extensions, 55, 55'. These extensions, which may be about 180 degrees apart, are connected by the central portion of groove segment, 54. These extensions connect to oppositely pressurized rotor channels, 15, 15', as they simultaneously depressurize and pressurize the channels, thus partially pressuring one channel and partially depressurizing the other channel so that the delta P upon reaching the aperture in the end plate is less then the delta P to initiate cavitation. The angles of two opposing groove extensions, 55, 55', are set so that the rotor channels 15, 15', simultaneously pressurize and depressurize one another as described above. The anti-cavitation groove, 54, may be located inboard of the apertures, 37, 39, and 63, 65, or outboard of the apertures, or both inboard and outboard of the apertures.

The groove, 54, has dimensions to bleed pressure at a rapid enough rate to avoid cavitation at the apertures. This is generally a width of from about 0.01 to about 0.1 inch deep, and from about 0.01 to about 0.1 inch wide. The cross-sectional shape of the groove 54 may be triangular, rectangular, or semicircular. The exact cross sectional shape, depth, and width for any combination of flow rates and pressure differences may be determined by modeling or experimentation.

The rotary pressure exchanger, 10, of the invention is useful with a seawater reverse osmosis (SWRO) system, 101, as illustrated in FIG. 9. The SWRO system, 101, has a reverse osmosis cell, 102, which receives pressurized sea water, 103', from the pressure exchanger, 10, and osmotically separates the pressurized sea water, 103', into a low solids content product portion, 109, and a high solids content effluent portion, 107. The high solids content effluent portion, 107, is concentrated brine, and is output at a high pressure. The pressure exchanger, 10, receives the high solids content, concentrated brine effluent, 107, from the seawater reverse osmosis cell, 102, and transfers the pressure of the high solids content concentrated brine effluent, 107, to a low pressure seawater feed, 103.

In the SWRO process, 101, a semipermeable membrane is used to separate salt and minerals from pressurized sea water, 103'. In order to overcome osmotic pressure across the membrane, the sea water, 103', must be pressurized to a high pressure, for example above about 1000 psi, for feed, 103', to the SWRO cell, 102. Typically about 30% of the pressurized seawater, 103', pumped into a SWRO reverse osmosis membrane cell, 102, will exit as fresh water, 109, (also referred to as product or permeate or potable water). The remaining 70% exits the membrane as a highly concentrated brine solution, 107, (concentrate, reject, effluent, or concentrated brine) at a high pressure.

In the SWRO process, pressurized feed water (sea water), 103', and make-up seawater, 103*a*, both with an initial salt content of about 28,000 to 35,000 or even 40,000 ppm Total Dissolved Solids (TDS) content is fed to the reverse osmosis cell, 102, at a pressure of about 1000 psi to produce 30 percent of feed as a product water, 109, greatly reduced in salt content, with a total dissolved solids (TDS) level of about 2,000 ppm TDS or less, and preferably a potable water containing less than 10,000 ppm TDS, and about 70% of feed is recovered as a concentrated brine, 107, containing 40,000 to 70,000 ppm of Total Dissolved Solids.

In the SWRO process, 101, a pressure exchanger, 10, is used to recapture the high pressure of the concentrated product, 107, and use it to pressurize the inlet feed (sea water). The integrated system, 101 has an SWRO cell, 102, and a pressure exchanger, 10. The salt water feed, 103, to the system, 101, generally, and to the pressure exchanger, 10, particularly, is low pressure seawater, 103, for example atmospheric pressure seawater. As noted above, the sea water feed must be pressurized in order to allow the SWRO cell, 102, to separate the pressurized sea water, 103', into concentrated brine, 107, and relatively pure water, 109.

The pressure exchanger, 10, pressurizes the seawater feed, 103, using the high pressure, concentrated brine effluent, 107, as the source of the high pressure. The high pressure, concentrated brine effluent, 107, of the SWRO cell, 102, returns to the pressure exchanger, 10, where it transfers some of its pressure to the salt water feed, 103, and is discharged.

While the invention has been described with respect to certain preferred embodiments and exemplifications, it is not intended to limit the invention thereby, but solely by the claims appended hereto.

We claim:

1. A pressure exchanger for transfer of pressure from a high pressure liquid to a low pressure liquid, said pressure exchanger comprising:

a housing having a body portion;

first and second ends plates at opposite ends of the body portion, the end plates each having an inlet aperture and an outlet aperture for respective liquid flow; and a rotor arranged for rotation in the body portion of the housing, the rotor having ends in substantially sealing contact with the end plates, said rotor having at least one channel therein extending substantially longitudinally from one end of the rotor to an opposite end of the rotor, the channel having an opening in each of said ends of the rotor adapted to contain a working liquid;

the inlet and outlet apertures of the first end plate forming a pair of apertures, one for high pressure liquid and one for low pressure liquid, and the inlet and outlet apertures of the second end plate forming a pair of apertures, one for low pressure liquid, and one for high pressure liquid, the apertures for high pressure liquid in the end plates being aligned with each other, and the apertures for low pressure liquid in the end plates being aligned with each other;

the channel being positioned in the rotor for alternate simultaneous fluid communication with apertures for high pressure liquid in the first and second end plates and thereafter with apertures for low pressure liquid in the first and second end plates during rotation of the rotor, such that the channel alternately is in hydraulic communication with two liquids under high pressure and thereafter with two liquids under low pressure; and a groove in at least one of said end plates, said groove positioned to communicate with the channel to change the pressure of the working fluid in the channel.

2. The pressure exchanger of claim 1 wherein said groove is recessed into said at least one of the end plates from one of the rotor ends.

3. The pressure exchanger of claim 1, wherein:

said rotor has at least two substantially longitudinal channels therein, said substantially longitudinal channels being positioned for alternately communicating with low pressure first and second liquids and thereafter with high pressure first and second liquids whereby a first one of said substantially longitudinal channels is at high pressure and a second one of said substantially longitudinal channels is at low pressure, and subsequently the first one of said substantially longitudinal channels is at low pressure and the second one of said substantially longitudinal channels is at high pressure; and wherein said groove recessed into at least one of the end plates provides a pressure shunt from the substantially longitudinal channel at high pressure to the substantially longitudinal channel at low pressure.

4. The pressure exchanger of claim 3 wherein said groove has a central portion in communication with at least one extension, said at least one extension being positioned for hydraulic communication with a channel opening.

5. The pressure exchanger of claim 3 wherein said groove has a central portion in communication with two extensions, one extension being positioned for hydraulic communication with a channel opening at low pressure and the other extension being positioned for hydraulic communication with a channel opening at a high pressure.

6. The pressure exchanger of claim 1, wherein said groove in said at least one end plate overlays the opening in the substantially longitudinal channel in the rotor before the substantially longitudinal channel discharges high pressure, said groove being recessed and adapted to bleed pressure into a liquid seal between the one end of the cylindrical rotor and one of said first and second end plates.

7. The pressure exchanger of claim 1 wherein said housing is cylindrical.

8. A pressure exchanger for transfer of pressure energy from a high pressure liquid to a low pressure liquid, said pressure exchanger comprising:

a housing having a body portion;

first and second end plates at opposite ends of the body portion, the end plates each having an inlet aperture and an outlet aperture for respective liquid flow; and a rotor arranged for rotation in the body portion of the housing and in substantially sealing contact with the end plates at a liquid seal therebetween, said rotor having at least one channel therein extending substantially longitudinally from one end of the rotor to an opposite end of the rotor, the channel having an opening in each end of the rotor;

a first pair of the apertures of the first and second end plates, aligned with one another for hydraulic communication through the channel and forming a pair of apertures for high pressure liquids, and a second pair of the apertures of the first and second end plates, aligned with one another for hydraulic communication through the channel and forming a pair of apertures for low pressure liquids;

the channel of the rotor being positioned in the rotor for hydraulic communication with the high pressure pair of apertures and thereafter with the low pressure pair of apertures, such that the channel alternately is in hydraulic communication with liquid under high pressure and thereafter with liquid under low pressure during rotation of the rotor; and one or more grooves in said end plates, said grooves being positioned to provide hydraulic communication between the openings of the channels and the liquid seal between the rotor and the end plates.

9. The pressure exchanger according to claim 8 wherein said grooves are recessed into each of the end plates.

10. A pressure exchanger for transfer of pressure from a high pressure liquid to a low pressure liquid, said pressure exchanger comprising:

a housing having a body portion;

first and second end plates at opposite ends of the body portion, the end plates each having an inlet aperture and an outlet aperture for respective liquid flow, the apertures in one end plate being aligned with the apertures in the other end plate; and a rotor arranged for rotation in the body portion of the housing and in substantially sealing contact with the end plates at a liquid seal, said rotor having at least one channel therein extending substantially longitudinally from one end of the rotor to an opposite end of the rotor, the channel having an opening in each end of the rotor, a first pair of the apertures of the first and second end plates, aligned with one another for hydraulic communication through the channel and forming a pair of apertures for high pressure liquids, and a second pair of the apertures of the first and second end plates, aligned with one another for hydraulic communication through the channel and forming a pair of apertures for low pressure liquids;

the channel of the rotor being positioned in the rotor for hydraulic communication with the first pair of apertures and thereafter with the second pair of apertures such that the channel alternately is in hydraulic communication with liquid under high pressure and thereafter with liquid under low pressure during rotation of the rotor; and an anti-cavitation structure in the end plates to provide a pressure change in said channel while the channel is blocked by the end plates.

11. The pressure exchanger of claim 10 wherein the rotor comprises two or more substantially longitudinal channels, and the anti-cavitation structure joins openings of said channels to bleed pressure from a higher pressure channel to a lower pressure channel.

12. The pressure exchanger of claim 10 wherein said anti-cavitation structure joins an opening of a channel to the liquid seal between the rotor and the one end plate.

13. A pressure exchanger for transfer of pressure energy from a high pressure liquid to a low pressure liquid, said pressure exchanger comprising:

a housing having a cylindrical body portion;

first and second end plates at opposite ends of the cylindrical portion, the end plates each having two apertures, one for high pressure liquid and one for low pressure liquid, the high pressure aperture of one end plate being aligned with the high pressure aperture of the opposite end plate, and the low pressure aperture of one end plate being aligned with the low pressure aperture of the opposite end plate; and a cylindrical rotor arranged for rotation in the cylindrical body portion of the housing and in substantially sealing contact with the end plates at liquid seals, said rotor having one or more channels therein extending substantially longitudinally from one end of the rotor to an opposite end of the rotor, the channel having an opening in each end of the rotor, the channels being positioned in the rotor for alternate hydraulic communication with both of the high pressure apertures and thereafter with both of the low pressure apertures, such that each channel alternately is in hydraulic communication with liquid under high pressure and thereafter with liquid under low pressure during rotation of the rotor; and one or more grooves in said end plates, said grooves joining openings of the channels with the liquid seals being between the rotor ends and the end plates, and each said groove being recessed into each said end plate.

14. The pressure exchanger of claim 13 wherein the grooves in at least one of said end plates bleed pressure from a higher pressure channel to a lower pressure channel.

15. A pressure exchanger comprising a first rigid container containing a liquid at high inlet pressure and a low outlet pressure, a second rigid container containing a liquid at low inlet pressure and a high outlet pressure, and a channel for transferring hydraulic pressure therebetween, said channel containing a working fluid and having one or more openings for hydraulic communication with the high pressure liquid in both chambers and thereafter with the low pressure liquid in both chambers, said channel and rigid containers having means for bleeding pressure from the channel to avoid cavitation.

16. A seawater reverse osmosis system comprising a reverse osmosis cell and a pressure exchanger, the reverse osmosis cell receiving pressurized sea water from the pressure exchanger, separating the pressurized sea water into a low solids content product portion and a high solids content effluent portion, said high solids content effluent portion being at a high pressure, said pressure exchanger receiving the high solids content effluent from the seawater reverse osmosis cell, and transferring the pressure of the effluent to seawater feed, said pressure exchanger comprising:

a housing having a body portion;

first and second end plates at opposite ends of the body portion, the end plates each having an inlet aperture and an outlet aperture for respective liquid flow, the high pressure liquid apertures of the first end plate being aligned with the high pressure liquid apertures of the second end plate, and the low pressure liquid apertures of the first end plate being aligned with the low pressure liquid apertures of the second end plate; and a rotor arranged for rotation in the body portion of the housing and in substantially sealing contact with the end plates at liquid seals, said rotor having at least one channel therein extending substantially longitudinally from one end of the rotor to an opposite end of the rotor, said one channel having an opening in each end of the rotor;

said one channel of the rotor being positioned in the rotor for hydraulic communication with the aperture pairs, such that the channel alternately is in hydraulic communication with liquid under high pressure and thereafter with liquid under low pressure during rotation of the rotor; and one or more grooves in said end plates, said one groove overlaying the opening in said one channel at one end of the rotor to bleed pressure therefrom and said one groove being recessed into the one end plate from the one rotor end.

17. The seawater reverse osmosis system of claim 16 wherein the rotor has two or more channels, and the one or more grooves in at least one of said end plates join openings of the channels.

18. The seawater reverse osmosis system of claim 16, wherein said grooves in said end plates join openings of the channel with the liquid seals being between the rotor ends and the end plates.

* * * * *

UNITED STATES PATENT AND TRADEMARK OFFICE

CERTIFICATE OF CORRECTION

PATENT NO. : 6,540,487 B2
APPLICATION NO. : 09/833252
DATED : April 1, 2003
INVENTOR(S) : Polizos et al.

It is certified that error appears in the above-identified patent and that said Letters Patent is hereby corrected as shown below:

The following should appear on the Title Page:

--(30) Foreign Application Priority Data

Apr. 11, 2000 (NO) ..... 20001877--.

Signed and Sealed this

Twelfth Day of August, 2008

JON W. DUDAS
*Director of the United States Patent and Trademark Office*